US009488050B2

(12) United States Patent
Pecorari

(10) Patent No.: US 9,488,050 B2
(45) Date of Patent: Nov. 8, 2016

(54) RADIAL CYLINDER HYDRAULIC MACHINE WITH IMPROVED OSCILLATING RADIAL CYLINDER

(75) Inventor: Piercelestino Pecorari, Modena (IT)

(73) Assignee: R. & D. S.R.L., Modena (IT)

( * ) Notice: Subject to any disclaimer, the term of this patent is extended or adjusted under 35 U.S.C. 154(b) by 652 days.

(21) Appl. No.: 13/884,534

(22) PCT Filed: Nov. 9, 2011

(86) PCT No.: PCT/IB2011/002648

§ 371 (c)(1),
(2), (4) Date: Jun. 26, 2013

(87) PCT Pub. No.: WO2012/063119

PCT Pub. Date: Nov. 9, 2011

(65) Prior Publication Data

US 2013/0284014 A1 Oct. 31, 2013

(30) Foreign Application Priority Data

Nov. 10, 2010 (IT) ..... MO2010A0321
Jan. 10, 2011 (IT) ..... MO2011A0001

(51) Int. Cl.
*F01C 9/00* (2006.01)
*F01B 1/06* (2006.01)
(Continued)

(52) U.S. Cl.
CPC ..... *F01C 9/00* (2013.01); *F01B 1/062* (2013.01); *F01B 1/0655* (2013.01); *F01B 15/005* (2013.01); *F04B 1/0421* (2013.01); *F04B 1/053* (2013.01); *F04B 1/0538* (2013.01)

(58) Field of Classification Search
CPC ..... F04B 1/0421; F04B 1/053; F04B 1/013; F04B 1/1133; F04B 1/0538; F04B 49/126; F04B 39/0094; F01B 1/062; F01B 1/0655; F01B 15/005; F01B 1/0448; F01B 1/0536; F01B 1/1136; F01B 19/027; F01B 27/0423; F01B 27/0663; F01B 3/0035; F01B 5/006; F01B 15/04; F01C 9/00
USPC ..... 96/66; 417/273, 221; 180/65.51, 305
See application file for complete search history.

(56) References Cited

U.S. PATENT DOCUMENTS 3,274,946 A * 9/1966 Simmons ..... F01B 1/0644 91/486
3,656,407 A * 4/1972 Hause ..... F01B 15/005 91/490

(Continued)

FOREIGN PATENT DOCUMENTS

| | | | |
|---|---|---|---|
| EP | 0172076 | A1 | 2/1986 |
| EP | 0491398 | A1 | 6/1992 |
| WO | WO 03/078822 | A1 | 9/2003 |

OTHER PUBLICATIONS

International Search Report in PCT/IB2011/002648 dated Jul. 12, 2012 (English Translation Thereof).

*Primary Examiner* — F. Daniel Lopez
*Assistant Examiner* — Richard Drake
(74) *Attorney, Agent, or Firm* — McGinn IP Law Group, PLLC

(57) ABSTRACT

A hydraulic machine includes oscillating radial cylinders close to an external shell of a crown or star of cylinder-piston groups. The pistons of the groups are made sliding on a crank shaft with throw or on interposed concentric elements, which create an alternative movement in the oscillating radial cylinders. The oscillating cylinders are placed in contact with a spherical oscillation surface made on a body or shell of the hydraulic machine. A passage of the hydraulic liquid to and from the oscillating radial cylinder, to create feeding and discharge of the cylinder, is formed through at least a flat lateral external surface on the side of the oscillating cylinder, parallel to an oscillation plane of the cylinders, to and from a feeding channel on a lateral body or cover of the hydraulic machine. A seal ring, fitted at least with a contact surface that is resistant to abrasion on the wall of the lateral flat sliding surface, is interposed between the flat lateral surface in contact for passage of the liquid under pressure, and a thrust member is formed on the oscillating cylinders against the spherical oscillation surface outside of the cylinders themselves.

13 Claims, 12 Drawing Sheets

(51) Int. Cl.

| | |
|---|---|
| ***F01B 15/00*** | (2006.01) |
| ***F04B 1/04*** | (2006.01) |
| ***F04B 1/053*** | (2006.01) |

(56) References Cited

U.S. PATENT DOCUMENTS 3,695,146 A * 10/1972 Orshansky, Jr. ..... F01B 1/0644 91/478
3,747,578 A 7/1973 Pickens
3,885,459 A 5/1975 Freese
3,945,766 A * 3/1976 Gelon ..... F04B 1/113 417/273
4,303,250 A * 12/1981 Persson ..... F16J 15/3268 277/585
4,609,128 A 9/1986 Amellal
4,926,803 A * 5/1990 Szewczyk ..... F01B 1/062 123/54.1
4,963,075 A 10/1990 Albertson et al.
5,146,880 A * 9/1992 Mayne ..... F01B 1/062 123/197.1
5,209,155 A 5/1993 Szewczyk
5,636,561 A * 6/1997 Pecorari ..... F04B 1/2035 123/43 A
5,967,018 A * 10/1999 Breveglieri ..... F03C 1/0605 417/269
6,622,706 B2 9/2003 Breeden
9,080,559 B2 * 7/2015 Pecorari ..... F01B 1/062

* cited by examiner

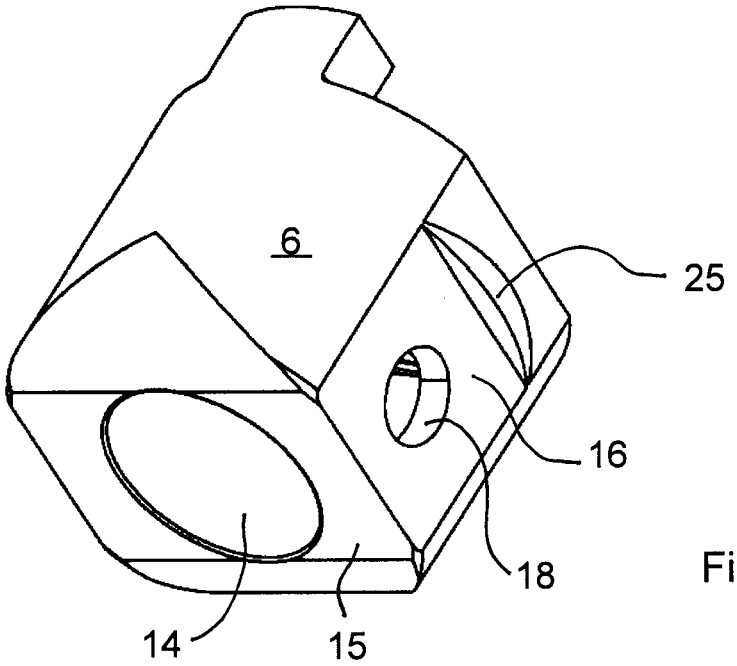
Fig. 6
Fig. 7
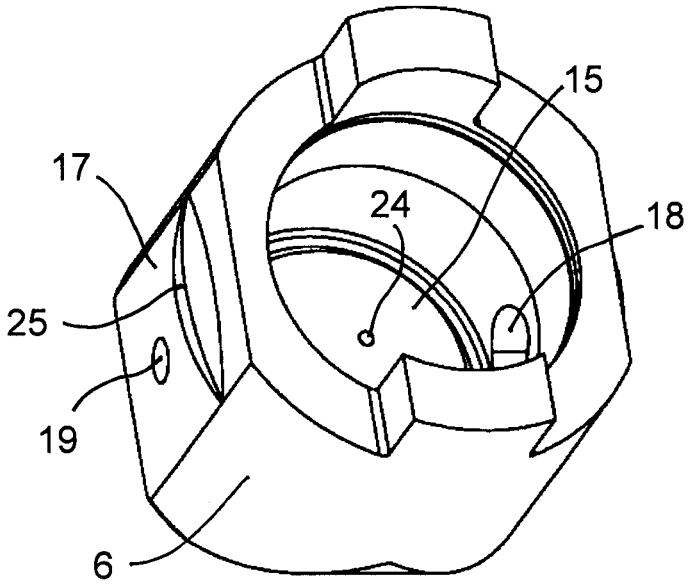

Fig. 10
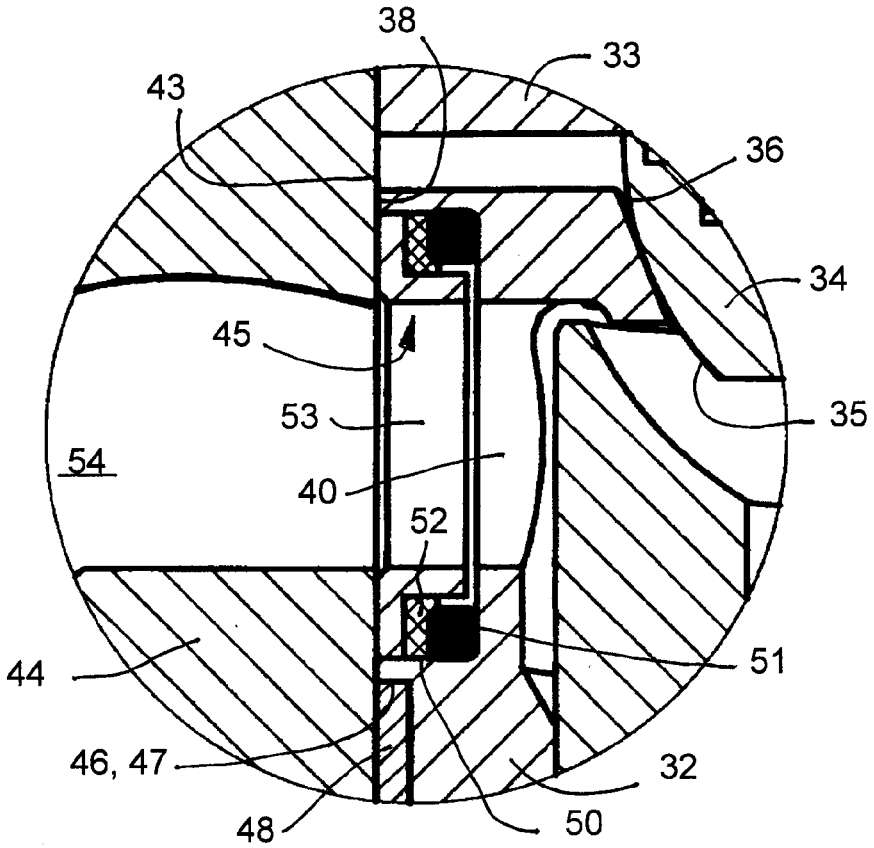
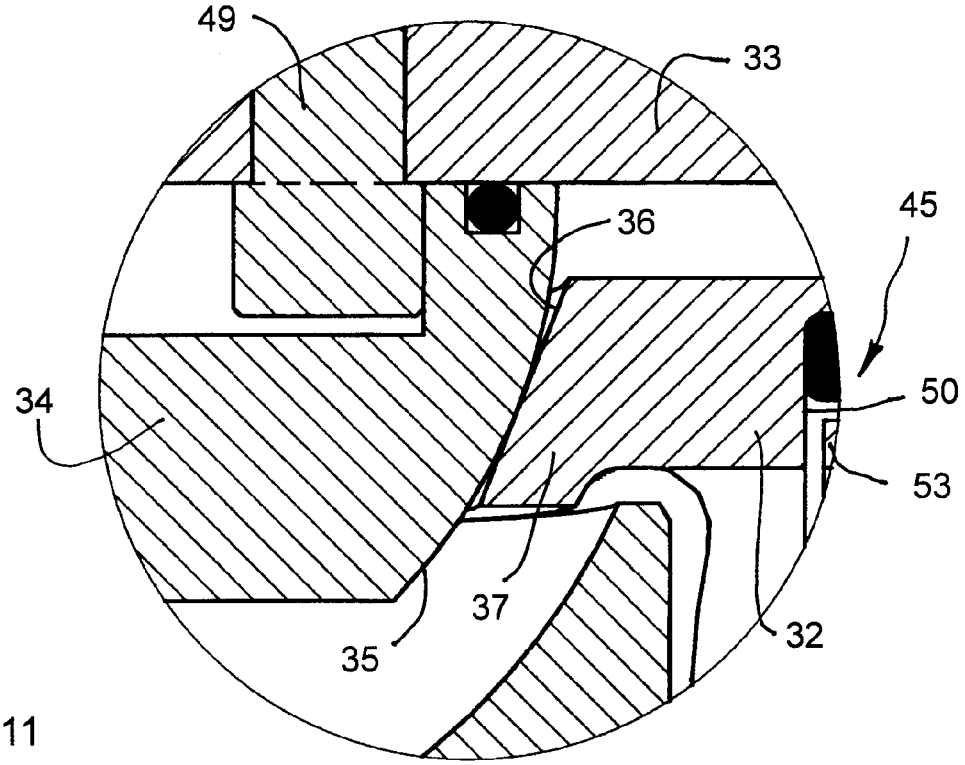
Fig. 11

Fig. 18
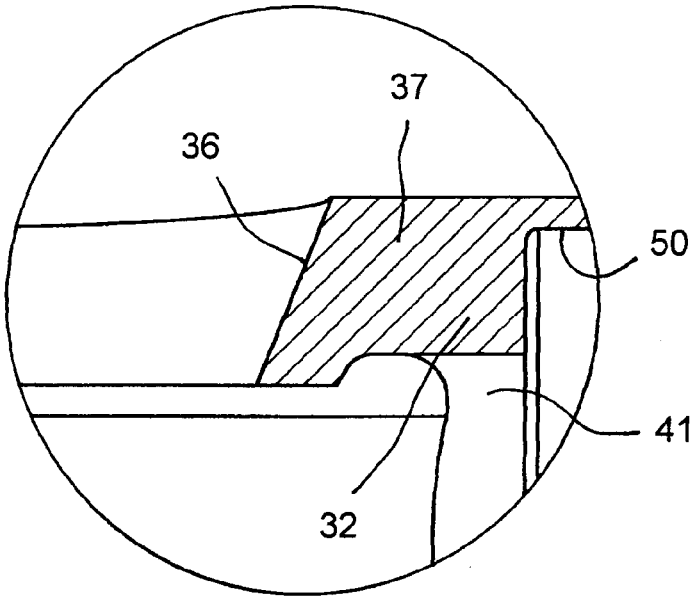
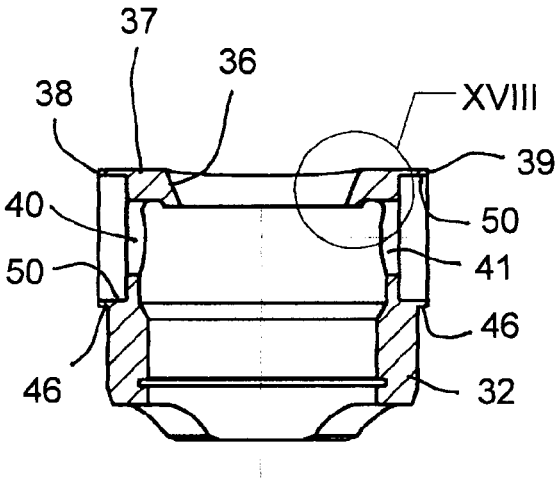
Fig. 16
Fig. 17
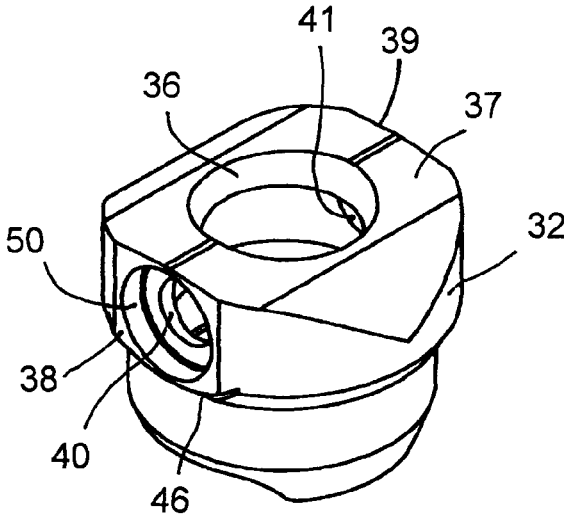

Fig. 22
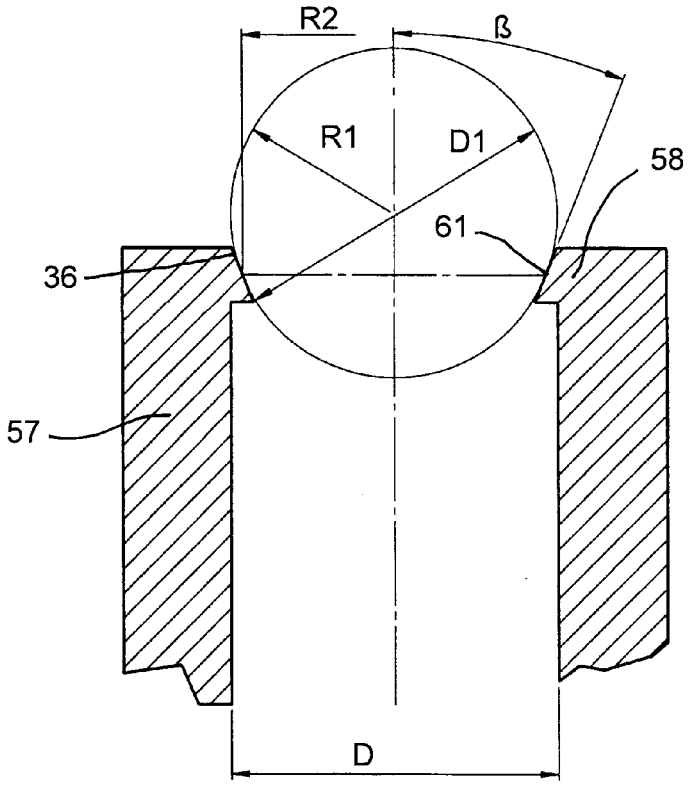
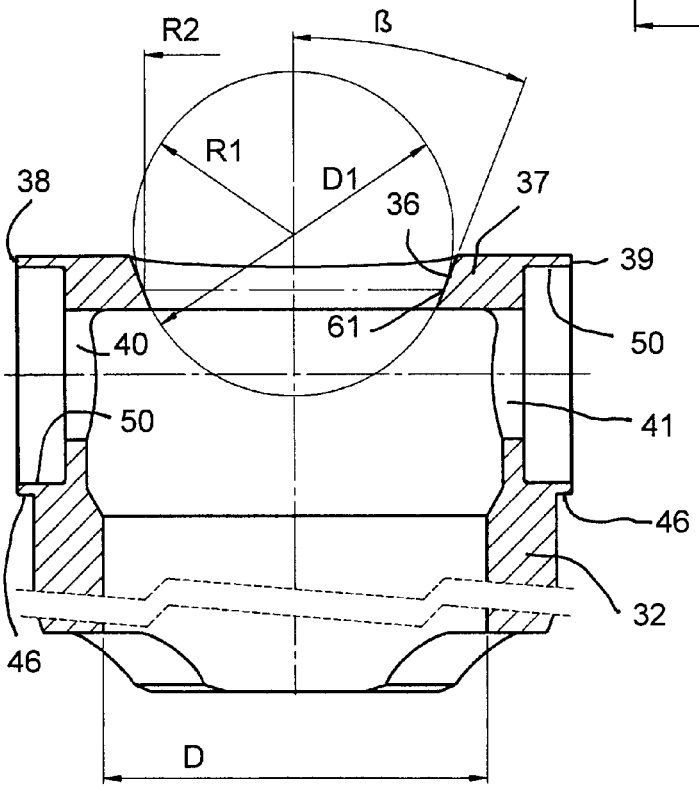
Fig. 21

Fig. 23
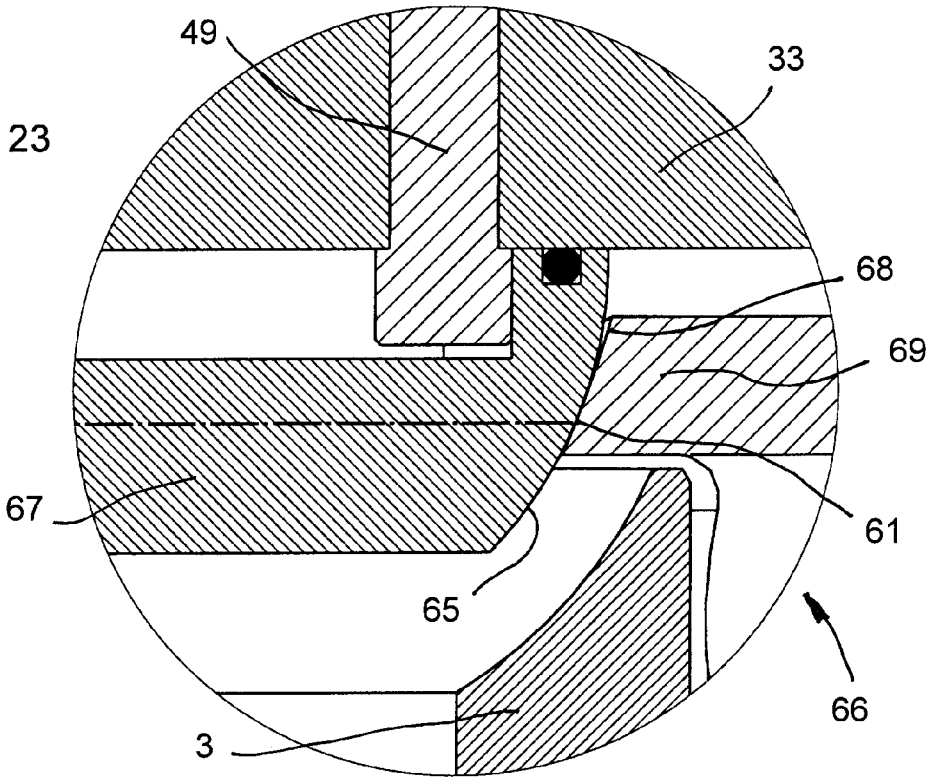
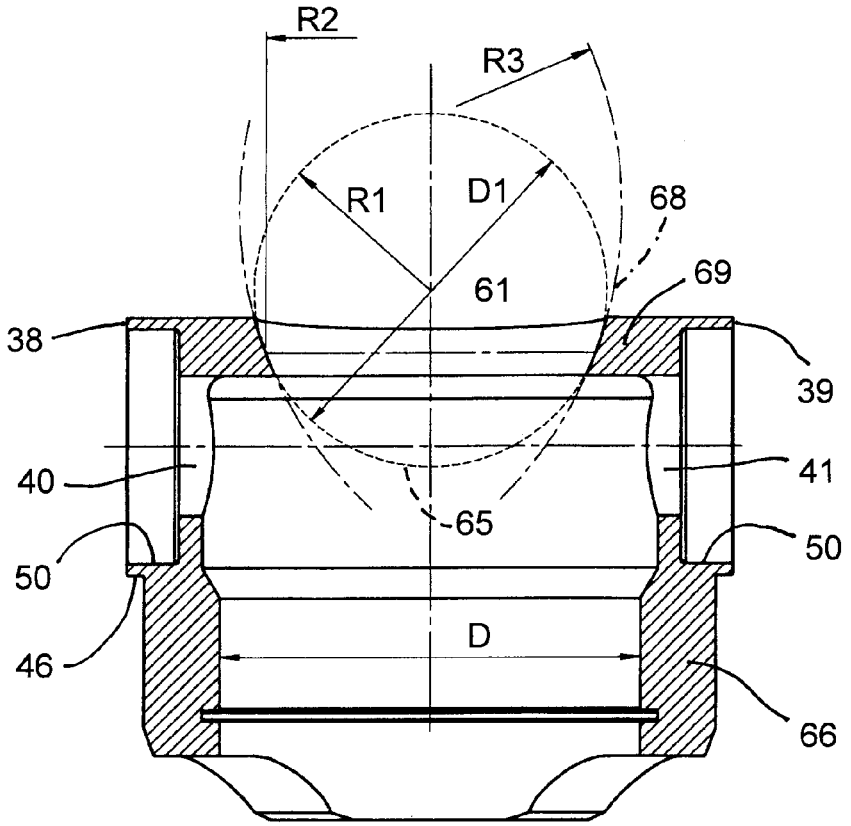
Fig. 24

RADIAL CYLINDER HYDRAULIC MACHINE WITH IMPROVED OSCILLATING RADIAL CYLINDER

FIELD OF APPLICATION

The present invention refers to a radial cylinder hydraulic machine, that is to say a perfected oscillating cylinder, of the type well known in this technique, for a radial cylinder hydraulic machine where cylinders positioned in a star and act all of them on the same eccentric or throw of crankshaft are positioned in oscillation compared with the body of the machine. The oscillating radial cylinder, as indicated in the description attached, has perfected characteristics compared with the technical note of the radial hydraulic machines in order to achieve important technical-economic results compared with the said technical note.

KNOWN ART

The state of the technique includes various types of radial hydraulic machines with cylinders positioned in a star and, in particular, includes those in which the single cylinder oscillates around an axis, close to the external diameter of the casing of the hydraulic machine, in order to perform the oscillation requested by the crank shaft that it is in contact with and operates with its rotating movement. This oscillation is obligatory as the cylinder-piston element, even though still subject to alternative movement of capacity execution, acts as a "push rod" in the mechanical concept of crank gear of the pin, therefore of the throw or eccentricity of the crank shaft: the so-called "rod" therefore is of a variable length according to the development of the capacity with movement of the liquid towards or from the oscillating radial cylinder in question. The respective piston is positioned in such a way as to roll along the external surface of the throw or eccentric, or mediated with interposed concentric elements, rotating with it.

In the technique, as mentioned above, these hydraulic machines are created with various support methods for cylinder oscillation: the first through side trunnions, positioned on an oscillation axis parallel to the axis of the crankshaft and positioned close to the external shell of the machine, they allow for passage of the hydraulic oil through one of the trunnions, in order to position the most bulky part of the cylinder, the liner and the external shell far from the throw and to achieve greater flow rates of the same dimensions, while passage of the hydraulic oil in the trunnion makes it weak to high working pressure, nowadays very usual in the field of this kind of hydraulic machines; a second method of oscillation of the cylinder-piston element in the hydraulic machine is to place the cylinder-piston element on a spherical surface, for each cylinder, positioned close to the external diameter of the shell of the hydraulic machine. The part sliding on the throw or on the eccentric of the crank shaft is located on an annular spherical surface, in an axial direction to the shaft, therefore in all cases it presents the sliding surface area with a preferential flat situation of the cylinder-piston element, that obviously corresponds to the flat situation of the spherical surface to be found at the most external diameter, to support the push generated in the cylinder for its alternative movement inside the piston. In reality, in this second method the technique also includes executions in which the piston is positioned close to the external diameter of the shell and the cylinder is positioned close to the internal diameter, therefore close to the sliding diameter on the eccentric or on the crank shaft, with a clear penalisation in dimensions and alternative movement created by the cylinder and not by the piston.

It is known that the first method of oscillation of the cylinder-piston element presents a critical point in the oscillation surfaces of the trunnions, as the thrusts generated by the hydraulic liquid in the cylinder are transmitted to the shell through said trunnions and, at the same time, at least one trunnion must be hollow in order to allow for the passage of the hydraulic liquid. Construction of the coupling of the trunnions with the shell is therefore very difficult and expensive, and due to the weakness of one of the trunnions it is also very limited in terms of performance and support of the thrusts generated. Furthermore, in hydraulic machines of this kind of a variable capacity at minimum values, but not inexistent, the range of oscillation in the trunnions is drastically reduced, while the thrusts on the trunnions are not reduced, so as to limit the value of the thrusts to the minimum flow rates and, therefore, the power and torque achievable at the minimum capacity that engines of variable capacity can reach.

In reality an important advantage of the radial cylinder hydraulic machines that normally result in better performance compared with other types of well known hydraulic machines, is that they have a huge capacity in terms of dimensions, therefore they can produce high couplings without working at very high pressures of the hydraulic liquid and, at the same time, can work at high rotation speed and therefore create a maximum elasticity of use that could not be achieved before with other kinds of hydraulic machines. Another limit that is indicated in the technical note is concentrated: in the increase of the passage of ports and power supply channels and/or discharge of the hydraulic liquid, currently not possible unless the dimensions are increate; in the reduction of the length of the channels themselves, therefore reducing the harmful volume that normally generates noise, due to the constant variation of pressure of the liquid column in which it is held, and therefore a loss in energy; in the reduction of the external dimensions of the machine, with the same capacity and mechanical performance, therefore preferable to users as it can be easily inserted in limited spaces and of reduced dimensions.

In the technique the document U.S. Pat. No. 3,695,146 is known, describing a hydrostatic motor with radial cylinders with capacity variation through variation of the eccentricity of the crank. Each cylinder has a spherical oscillation surface through which the channel of hydraulic liquid under pressure passes, feeding of the hydraulic liquid is carried out from a single slide valve distributor for each cylinder. The variation in eccentricity of the crank also involves regulation of the eccentric that controls the slide valves. A similar construction, developed in order to achieve high rotation speeds at minimum flow rates, loads the oscillation surface with radial thrusts, due to the pressure of the liquid and proportional to it, resulting in the fact that the higher the pressure, the higher the thrusts that generate oscillation fiction of the cylinder in its spherical housing. Finally, the spherical oscillation surface and the sliding casing on the eccentric crank are intentionally spherical in order to keep the pistons aligned on the eccentric.

Furthermore, in the technique the document FR 1.530.605 is also known, describing a hydraulic motor with oscillating radial cylinders with a spherical oscillating surface and in which lead-in ports and hydraulic liquid discharge, duly positioned in the oscillation arch, are found. Cylinder oscillation generates the distribution of hydraulic liquid to the relative cylinder. Therefore, even if feeding of the cylinder does not occur with axial channels to the cylinder, the dimension of the supply channels establishes the impossibility of proportioning the motor with a higher number of cylinders 5, 7 or 9 (it is illustrated with only three cylinders), that is well known to generate a much more regular driving torque, therefore preventing the achievement of much smaller dimensions for similar levels of performance compared with other hydraulic machines. This hydraulic motor is penalised, as the previous one, by the high spherical surface involved in the pressure, different on one side compared with the other, due to the distribution effect that the spherical surface has with oscillation of the cylinder, so as to maintain the unbalanced thrusts on the spherical surface.

In the second method of oscillation with the cylinder equipped with an axial channel of the cylinder-piston element, feeding, therefore the passage of hydraulic liquid to and from the cylinder, occurs from the outside of the spherical oscillation surface, therefore it is created by necessarily increasing the diameter of the shell or its dimension, so as not to allow for containment and limitation of the dimensions of the hydraulic machine that becomes much clearer and more penalising, especially when large dimensions are to be created, so much as a sto create large cylinders and high hydraulic liquid flow rates that cross the hydraulic machine. Therefore the dimensions of said channels are limited if the objective is a reduced radial dimension, in the case of feeding of the cylinder through the trunnion and in the case of feeding of the cylinder through the oscillation surface.

Therefore, in the second method of support of oscillation of the radial cylinders, as mentioned, the spherical surfaces are broad and created in such a way as to contain a meatus of hydraulic liquid to achieve the hydrostatic support of the cylinder, with the spherical surface resting on the spherical surface created or applied to the external shell of the hydraulic machine. The hydrostatic support of this meatus does not work in the very best conditions as the hydraulic liquid is trapped inside it, especially when the angle of oscillation of the cylinder is reduced, during variation controls of capacity due to the fact that the hydraulic motors are of a variable capacity according to operation at a minimum capacity: the meatus must have an annular surface in pressure of an adequate size in order to operate correctly, while the pressure of the hydraulic liquid is increate during use of the hydraulic machine, as often happens in engines that are made to work at a minimum capacity, therefore made with much larger dimensions of the surface with the meatus, so as to reduce the passage section of the hydraulic liquid that, as mentioned, occurs inside the annular spherical surface of oscillation.

Furthermore, in the technique the document EP 0491398 A1 is also known, describing the effect of the pressure of the hydraulic liquid in couplings, between the spherical oscillation surface of the pistons in a radial hydraulic motor with axial feeding through the spherical oscillation surface, confirming that the oscillation surface on the oscillating element must be small compared with the oscillation surface on the body or on the shell of the motor. However, this confirms how, in the presence of large surfaces in contact with oscillation, it is necessary to discharge the excessive meatus liquid that is formed on one side of it through a discharge channel inside the spherical oscillation surface. As in the case of previous documents, the high pressure that can be achieved and the low degree of oscillation generate an important level of fiction when the oscillation movement does not determine discharge of discharge of the liquid included in the spherical sections in contact with oscillation: therefore the need to facilitate clearance in order to replace the hydraulic liquid in the meatus.

Finally, the document WO 03/078822 A1 is known, describing the method of oscillation of the slide shoe on a eccentric of the level in a high pressure pump and liquid cylinders in line. The slide shoe acts as a short rod so as to create important angular excursions. The cylinder with hollow piston is powered in an axial direction by a suction channel in the eccentric of the crank and, with every lot the liquid is pushed through a non return circuit valve. Contact between the piston and the runner occurs with a spherical surface, one of which has a much wider radius so as to create contact in a band due to plastic yielding of one of the two materials of the piston or of the runner, so after the initial contact a wide spherical contact band between the piston and the runner. This operation is facilitated and compensated by the spring inside the piston that recovers the plastic yields that are found in the first use of the coupling, so as not to limit the contact band to the circumference.

This state of the technique is susceptible to further improvements with regards to the possibility of creating a perfected radial hydraulic machine, of an oscillating cylinder type, that exceeds the aforementioned problems and is made functional according to the reduction in dimensions and the masses interested in the spherical contact between the cylinder and body or the shell of the hydraulic machine.

Therefore, the technical problem that lies at the basis of this invention is to create a perfected radial hydraulic machine of the version with oscillating cylinders in which the cylinder-piston group is in contact with the engine body, or shell, creating dimensioning in the spherical contact so as to avoid the useless increase in the external dimensions of the hydraulic machine, when the intention is to create greater flow rates and/or large flow rates of liquid, however taking into consideration the known technical advantages that the radial cylinder hydraulic machines have achieved and that, with the change in the method of execution of the spherical contact of oscillation, may achieve in the perfection sought after in the reduction of dimensions.

Another but not last objective of this invention is to allow for the creation of a radial hydraulic machine with oscillating cylinders in which the reduction in dimensions with the same capacity or, vice versa, with the same dimensions, with an increase in the capacity achieved, it is possible to reduce the harmful levels present in the power/discharge conduits to and from the cylinders.

Finally, another part of the technical problem illustrated above refers to the creation of a perfected radial hydraulic machine of an oscillating cylinder type in which the section of the power/discharge conduits of the cylinders may be increased so as to make the effective passage of hydraulic liquid from the plant to the cylinders and vice versa much easier, with the objective of allowing for flow rates larger than the ones that can be created in the constructive solutions indicated in the technical note.

SUMMARY OF THE INVENTION

This problem is solved, according to this invention, by a radial cylinder hydraulic machine, including: oscillating radial cylinders close to the shell outside of the crown or star of cylinder-piston groups; the pistons of said groups become sliding on a crank shaft or on a eccentric, or on concentric interposed elements and, create the alternative movement in the oscillating radial cylinders; and, characterised in this, with said oscillating cylinders positioned in contact with a spherical oscillation surface created or included in the body or in the shell of the hydraulic machine; each oscillating radial cylinder fitted with an internal annular surface with a curve greater than the radius of the spherical oscillation surface, for coupling with said spherical oscillation surface, to create contact on a circumference with a band width due to the sole elastic yielding of the materials in a median area of the contact circumference; furthermore, the radius of the contact circumference is less than half the diameter of the bore of the cylinder; finally, it includes thrusting means of the oscillating cylinders against the oscillation spherical surface outside the cylinders themselves; and, advantageously, the diameter of the spherical oscillation surface is less than the bore diameter of the oscillating radial cylinder.

In a further and advantageous constructive form: the spherical surface of oscillation includes an annular conformation limited close to the median area of contact around the circumference of contact with the internal annular surface.

Even more, in a specific execution, the spherical surface of oscillation has a limited annular conformation close to a median area of contact in the area of the contact circumference with the internal annular surface consisting of an internal trunk-conical surface and the said trunk-conical surface presents, at the same time, a limited annular conformation close to the median area of contact with the spherical oscillation surface.

In another constructive form: the spherical surface of oscillation and an annular surface of the internal arch both have an annular conformation limited to the median narrow area of contact around the contact circumference between the oscillation surface of the hydraulic radial cylinder; the curved radius of the internal arched annular surface is greater than the radius of the spherical surface of oscillation and less than the infinite value.

Furthermore, in another form of execution that is rather advantageous, the feeding and/or discharge of the hydraulic liquid in the oscillating cylinder is carried out through one side of the cylinder itself through passage of the hydraulic liquid to and from the oscillating radial cylinder, to create feeding and discharge of the cylinder, at least through a lateral flat external surface on the side of the oscillating cylinder, parallel to the oscillation surface of the cylinders, to and from a feeding channel on the body or side cover of the hydraulic machine; a seal ring, fitted at least with a contact surface that is resistant to abrasion on the wall of the lateral sliding surface, is interposed between the lateral surface(s) in contact for passage of the feeding liquid under pressure.

In another constructive form: in a lateral flat external surface, parallel and opposed to the lateral flat external surface to the oscillating cylinder crossed by feeding of the liquid, there is a thrust compensation hole, fed by liquid under pressure in the oscillating cylinder, around which a ring seal is fitted at least with a cylinder surface that is resistant to abrasion on the wall of the flat lateral sliding surface, and it is also positioned between the lateral flat surface(s) in contact for the passage of liquid under pressure for the compensation hole.

Furthermore, in a specific execution the surface of action of pressure in said compensation hole of the thrusts or in one of its niches of the flat lateral sliding surface is slightly greater than the passage surface of the liquid under pressure in the feeding hole in the oscillating radial cylinder.

In another constructive form, the seal ring in sliding contact between the lateral external surface compared with the oscillating radial cylinder and a flat lateral surface of sliding of the cylinder consists of combined parts in which: a metallic ring creates the surface that is resistant to abrasion, on the side of the seal in contact with the sliding surface of the seal ring; a ring made from a soft flexible material is interposed between the metallic ring and the housing or niche in which the seal ring is held; an anti-extrusion ring is positioned in between the metallic ring and the ring in a soft flexible material to avoid expulsion for pressure of the liquid during operation.

Furthermore, in a more advantageous constructive form, the seal ring for the power hole and/or for the compensation hole of the thrusts is held in its own casing created in the side of the cylinder and the seal ring is in contact with sliding against the flat lateral surface of the body of the radial hydraulic machine and its cover.

Furthermore, in a preferred constructive form, the respective oscillation surface of each oscillating radial cylinder of the said cylinder-piston groups is created, close to the external shell, by a portion of spherical surface on a mechanical element and it is connected with the shell or with parts of lateral covers of the hydraulic machine in a mobile transversal mode in a direction parallel with the axle of the crank shaft.

Furthermore, in a specific constructive variation, a radial cylinder hydraulic machine, including oscillating radial cylinders close to the external shell of the crown or star of cylinder-piston groups; the pistons of said groups are made sliding on a crank shaft or eccentric, or on concentric interposed elements and create alternative movement in the oscillating radial cylinders; said oscillating cylinders positioned in contact with a spherical oscillation surface created or included in the body or shell of the hydraulic machine; characterised in this, that includes passage of the hydraulic liquid to and from the oscillating radial cylinder, to create feeding and discharge of the cylinder, through at least a flat lateral external surface of the oscillating cylinder, parallel to the oscillation surface of the cylinders, to and from a feeding channel on the body or on the lateral cover of the hydraulic machine; a seal ring, fitted at least with a contact surface that is resistant to abrasion on the wall of the lateral surface of the sliding plane, is positioned in between the flat lateral surfaces in contact for the passage of incoming liquid; finally thrust means of the oscillating cylinders can be found between the spherical oscillation surface outside the cylinders themselves.

Furthermore, in a preferred constructive form, to maintain contact between the oscillation surface of the oscillating radial cylinder and the body or shell of the hydraulic machine, the thrust means on the cylinder for contact consist of at least one ring fitted with arched contacts, compared with the curve axis of the portion of spherical surface of oscillation of each cylinder, according to a respective curve radius of arched steps on respective cylinders, coinciding with the curve radius compared with the oscillation surface of the cylinders on the arched connections of the thrust means.

Finally, in order to maintain contact between the oscillation surface of the oscillating radial cylinder and the body or shell of the hydraulic machine, the thrust means on the cylinder, for contact on the portion of oscillation, consist of arched wings on the side of the cylinder, consisting of arched casings, according to a respective curve compared with the curved axis of said portion of the oscillation surface of the cylinder-piston group.

The characteristics and advantages of this invention, in execution of the hydraulic machine with oscillating radial cylinders, created below, can be seen in examples of execution given as an example and are not limited with reference to the twelve drawings attached.

BRIEF DESCRIPTION OF THE DRAWINGS

FIGS. 6 and 7 represent perspective views of the cylinder with feeding on the side and on the surface of spherical oscillation, according to the invention, for the radial hydraulic machine as shown in the previous Figures;

FIG. 10 represents an enlargement of portion X of the schematic section of FIG. 8;

FIG. 11 represents an enlargement of portion XI of the schematic section of FIG. 8;

FIG. 16 represents a schematic section XVI-XVI of FIG. 12 of the oscillating cylinder on a diametric plane, as in FIG. 8, for the complete hydraulic machine;

FIG. 17 represents a perspective view of the cylinder with feeding on the side, according to the invention, for the radial hydraulic machine of previous FIGS. 8 to 16;

FIG. 18 represents an enlargement of portion XVIII of the schematic section of FIG. 16;

FIG. 21 represents the parameters of dimensioning of contact in the schematic section of the oscillating cylinder of the hydraulic machine of FIGS. 8 and 9, fitted with a limited contact coupling in the spherical trunk-conical form according to this invention;

FIG. 22 represents the parameters of dimensioning of the contact in a schematic section of a generic oscillating cylinder with axial feeding of a hydraulic machine with oscillating radial cylinders, fitted with limited contact spherical coupling, according to the present invention in FIG. 19;

FIG. 23 represents an enlargement of portion XI of the schematic section of FIG. 8, in the case of dimensioning of the spherical surface of oscillation contact with different curve radii, as illustrated in FIG. 24 below;

FIG. 24 represents a schematic section of the oscillating cylinder on a diametric plane, of a hydraulic machine according to the invention with the oscillation contact as in FIG. 8, with the parameters of dimensioning of the oscillation contact of a spherical surface according to another constructive form of the invention, against an arched annular surface at the bottom of the hydraulic oscillating radial cylinder.

DETAILED DESCRIPTION OF A PREFERRED FORM OF EXECUTION

Figure 1:
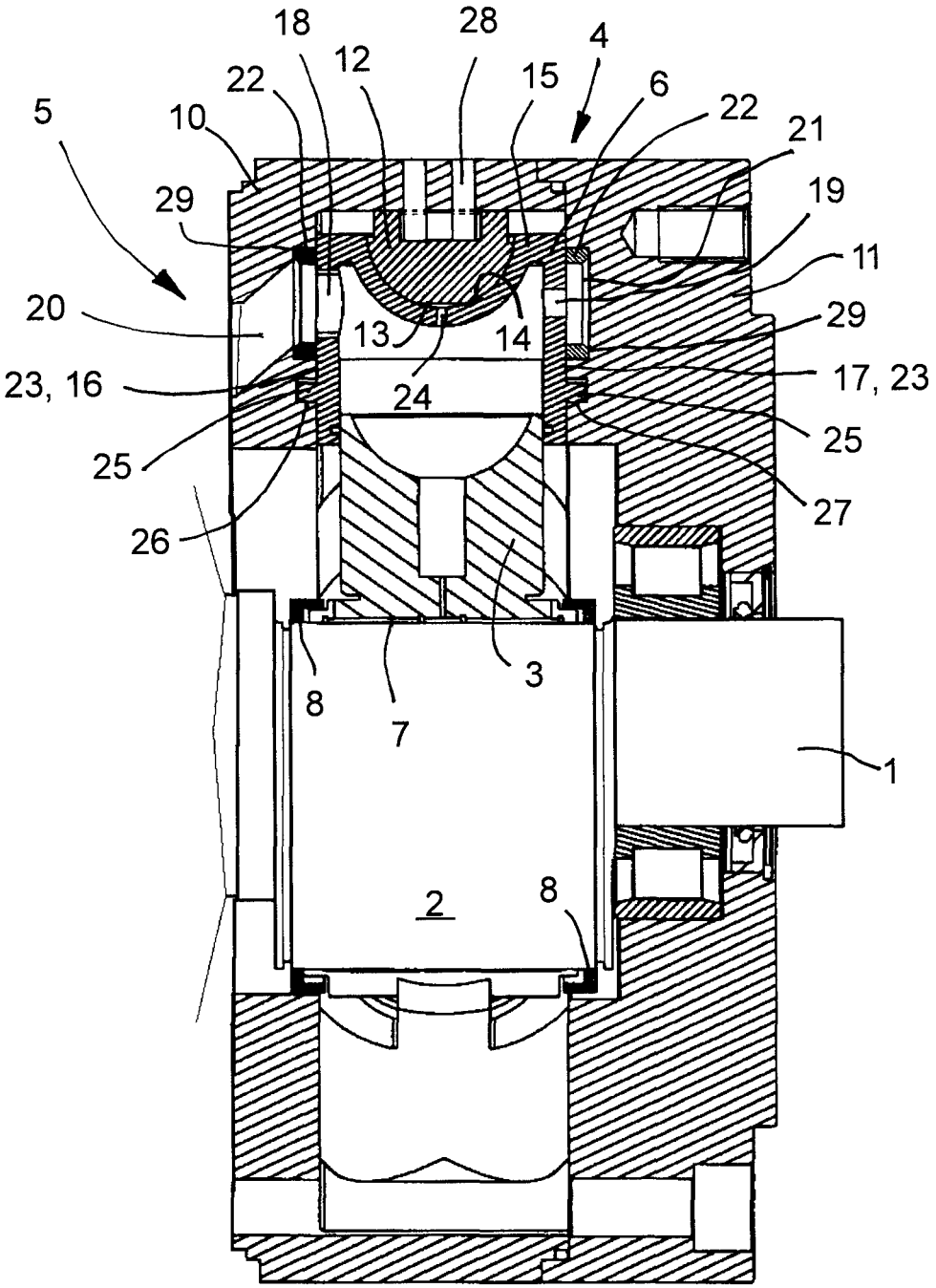
FIG. 1 represents a schematic section on a diametric plane passing through the axle of the crank shaft, in correspondence with an oscillating cylinder at the upper dead point, of a radial hydraulic machine fitted with feeding on the side of the cylinder and a spherical oscillation surface, according this invention.
Figure 2:
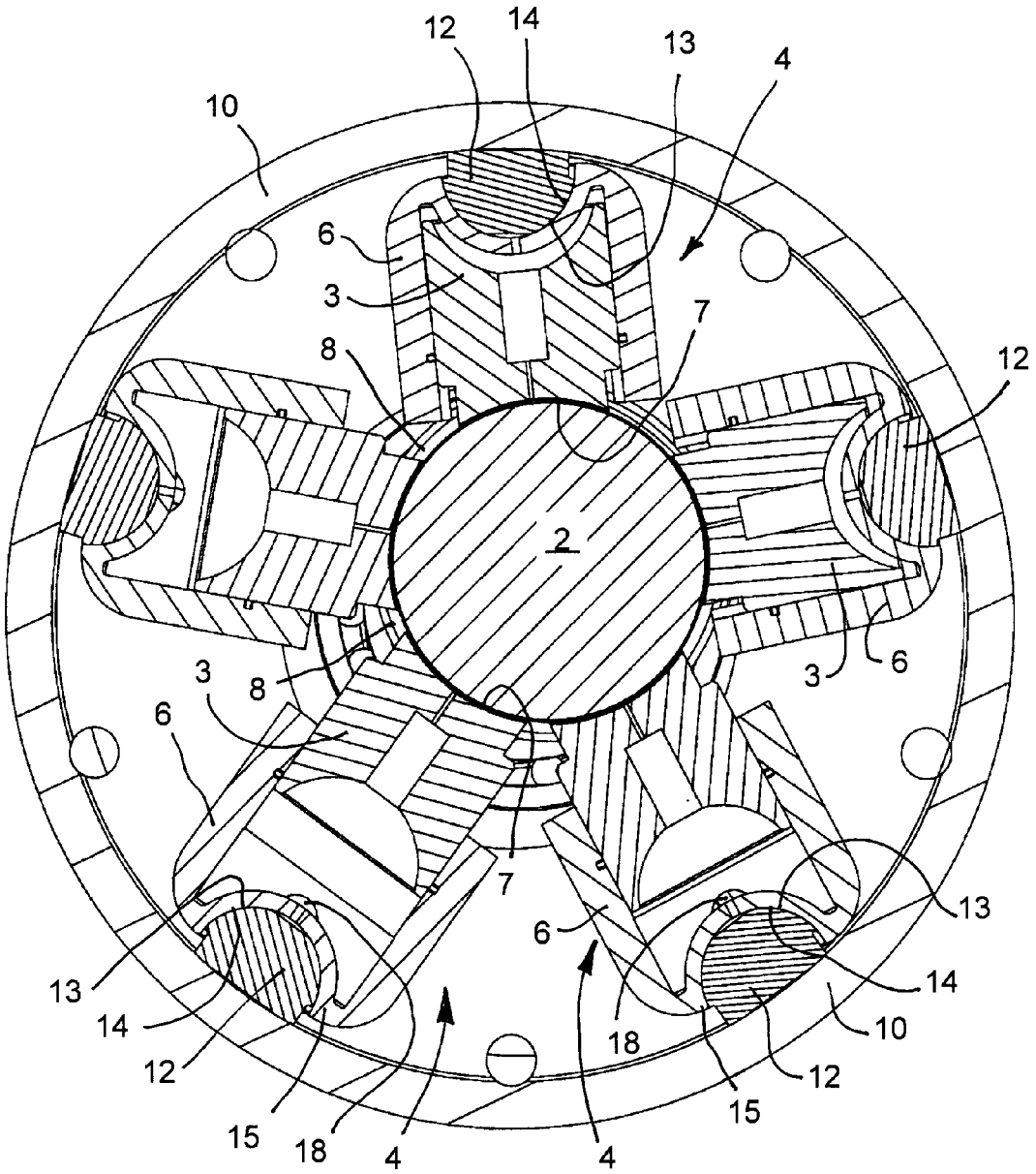
FIG. 2 represents a schematic diameter section of the hydraulic machine of FIG. 1, as indicated above, in which the radial oscillating cylinder-piston groups during rotation of the crank shaft are visible.
Figure 4:
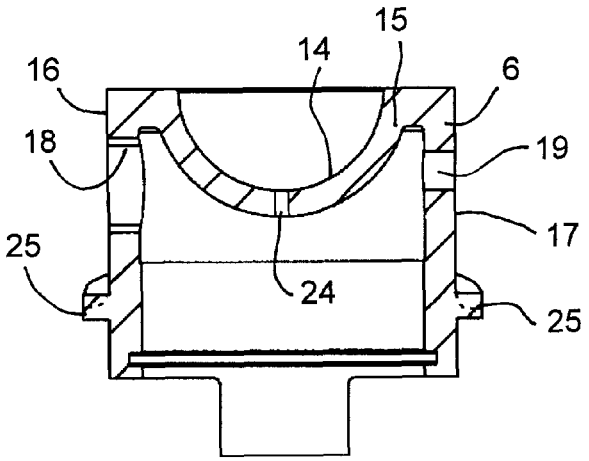
FIG. 4 represents a schematic layout IV-IV of FIG. 3, of the oscillating cylinder, on a diametric plane, as in FIG. 1, for the complete hydraulic machine.
Figure 3:
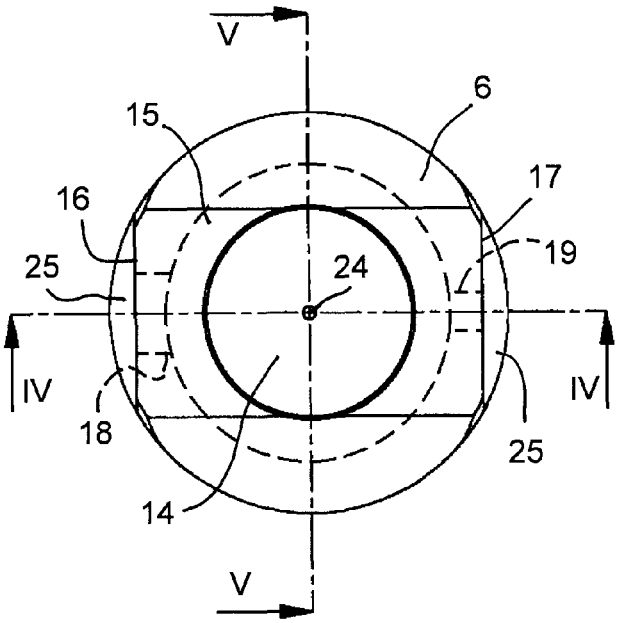
FIG. 3 represents an axial schematic layout on the side of the spherical surface of oscillation of the sole cylinder present in the radial hydraulic machine of FIGS. 1 and 2.
Figure 5:
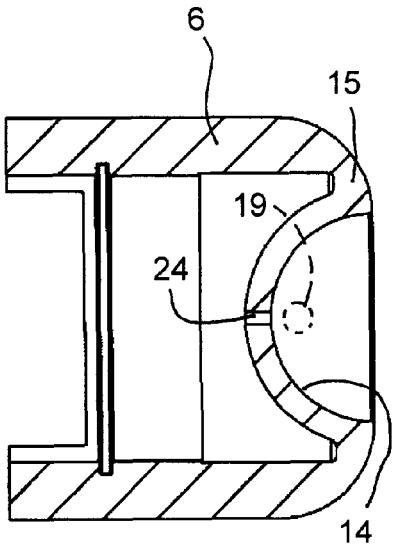
FIG. 5 represents a schematic section V-V of FIG. 3, of the oscillating cylinder, on a normal plane compared with the axis of the crank shaft, as in FIG. 2, for the complete hydraulic machine.

In FIGS. 1 to 7, in an initial constructive form of the perfected oscillating cylinder, according to the invention, a crank shaft 1 can be seen fitted with an throw or crank 2 on which pistons 3 of the groups 4 cylinder-piston, oscillating cylinder-piston of the hydraulic machine 5 with radial oscillating cylinders 6 can be found. The pistons 3 slide on the crank 2 in a known manner, through respective rollers 7 and seal rings 8. Each oscillating cylinder 6 is coupled in oscillation with the body 10 of the hydraulic machine 5, through spherical coupling between a mechanical element indicated 12 and a spherical surface 13, made axially that can be registered in a parallel direction to the crank shaft 1 and to a concave spherical surface 14 made on the external surface of the bottom 15 of the oscillating cylinder.

The cylinder 6 has a feeding hole 18 on two flat lateral external surfaces 16 and 17, parallel between them, on the side of the flat lateral parallel surface 16 and a feeding hole 18, on the side of the flat lateral parallel surface 16 and a thrust compensation hole 19 on the side of the flat lateral parallel surface 17 that respectively overlook a feeding channel 20, in correspondence with the feeding hole 18 in the cylinder 6 and in a compensation niche 21, in correspondence with the thrust compensation hole 19 in the cylinder 6. Contact between the external lateral parallel surface 16 of the cylinder 6 and the body 10 of the hydraulic machine 5, in the compensation niche 21, occurs through an identical seal ring 22 with a metallic contact surface; this sliding contact occurs on flat lateral sliding surfaces 23 on the body 10 and on the cover 11, between them parallel and perpendicular to the axis of the crank shaft 1 as well as parallel to the oscillation plane of the cylinders. A hole 24 in the bottom 15 of the cylinder 6 feeds the spherical concave surface 14 of the base of the cylinder using hydraulic liquid for lubrication. In correspondence with the flat lateral external surfaces 16 and 17 there are to be found arched wings 25 on both surfaces, with a curve corresponding to the spherical surface of oscillation of the cylinder 6 that are involved in corresponding arched housings 26 on the side of the body 10 of the hydraulic machine 5 and 27 on the side of the cover 11 in order to maintain the contact position between the spherical oscillation surface 13 of the mechanical element 12 and the concave element 14 on the external surface of the bottom 15 of the oscillating cylinder 6, when starting up and in the presence of pressure of the liquid in the cylinder. The mechanical element indicated 12 with the spherical oscillation surface 13 is made mobile, to allow for contact regulation between the flat lateral external surfaces 16 and 18 and the flat lateral sliding surfaces 23 on the body 10 and on the cover 11 of the hydraulic machine 5, through a sliding pin coupling 28 for a short distance in a perpendicular direction compared with the oscillation plane of the oscillating cylinders 6, so as to create the best possible seal between the flat lateral external surfaces 16 and 17 and the seal rings 22 in the housing 29 of the body 10 and in the compensation niche 21 in the cover 11 of the hydraulic machine 5.

In FIGS. from 8 to 18 in a second constructive form of perfected oscillating cylinder, according to the invention, apart from the elements previously mentioned for the previous constructive form and duly numbered, the groups 30 oscillating cylinder-piston of the hydraulic machine 31 with radial oscillating cylinders 32 can be seen. Each oscillating cylinder 32 is coupled in oscillation with the body 33 of the hydraulic machine 31, through coupling by means of a mechanical element 34 applied to the annular spherical surface 35, made axially that can be registered in a parallel direction to the crank shaft 1 and to an internal conical surface 36 made on the external surface of the bottom 37 of the oscillating cylinder 32.

On two flat lateral external surfaces 38 and 39, parallel between them, the cylinder 32 has a feeding hole 40, on the side of the flat parallel lateral external surface 38, and a similar hole 41 for compensation of thrusts, on the side of the flat parallel lateral external surface 39: the two parallel flat lateral external surfaces overlook similar flat lateral sliding planes 42 and 43 on the body 33 of the hydraulic machine 31 and on the cover 44 connected to assembly. Contact between the flat sliding lateral surface 32, on cover 44, and the corresponding flat lateral external parallel surface 40, occurs through a seal ring 45 on a metallic contact surface; in the same way, contact between the flat sliding lateral surface 42 on the body 33 of the hydraulic machine 31, on the side opposite the cylinder 32, is carried out through an identical seal ring 45 with a surface of metallic contact. In correspondence with the flat lateral external surface 38 and 39, at the bottom of their edges, on both of the surfaces, there is an arched step 46 with a curve corresponding to the spherical annular oscillation surface 35 of the cylinder 32, involved in corresponding arched elements 48 made on a ring 48 for each side of the cylinder-piston groups 30, with the objective of maintaining the contact position between the spherical annular surface of oscillation 35 of the mechanical element 34 and with the trunk-conical internal surface of the bottom 37 of the oscillating cylinder 32, at the start-up and in the absence of liquid pressure in the cylinder. The mechanical element indicated 34 with the spherical oscillation annular surface 35 has been made mobile, in order to allow for contact regulation between the flat lateral external surfaces 38 and 39 and the flat sliding lateral surfaces 42 and 43 on the body 33 and on the cover 44 of the hydraulic machine 31, by means of a sliding coupling 49, for a short length in a perpendicular direction to the oscillation plane of the oscillating cylinders 32, so as to create the best possible seal between the flat lateral external surfaces and the seal rings 45 in the respective housings 50 of the oscillating cylinder.

The seal rings 45, as can be better seen in FIG. 10, are a composition between a ring made from a soft flexible material 41 of a circular section, also known as the "O ring", sitting in housing 50 for each of the two lateral holes of the cylinder 32, an anti-extrusion ring 52 and a metallic contact ring 53 aimed at sliding against the flat lateral surface 42 or 43 on the side of the body 33 or on the side of the cover 44 of the hydraulic machine 31 illustrated.

Figure 8:
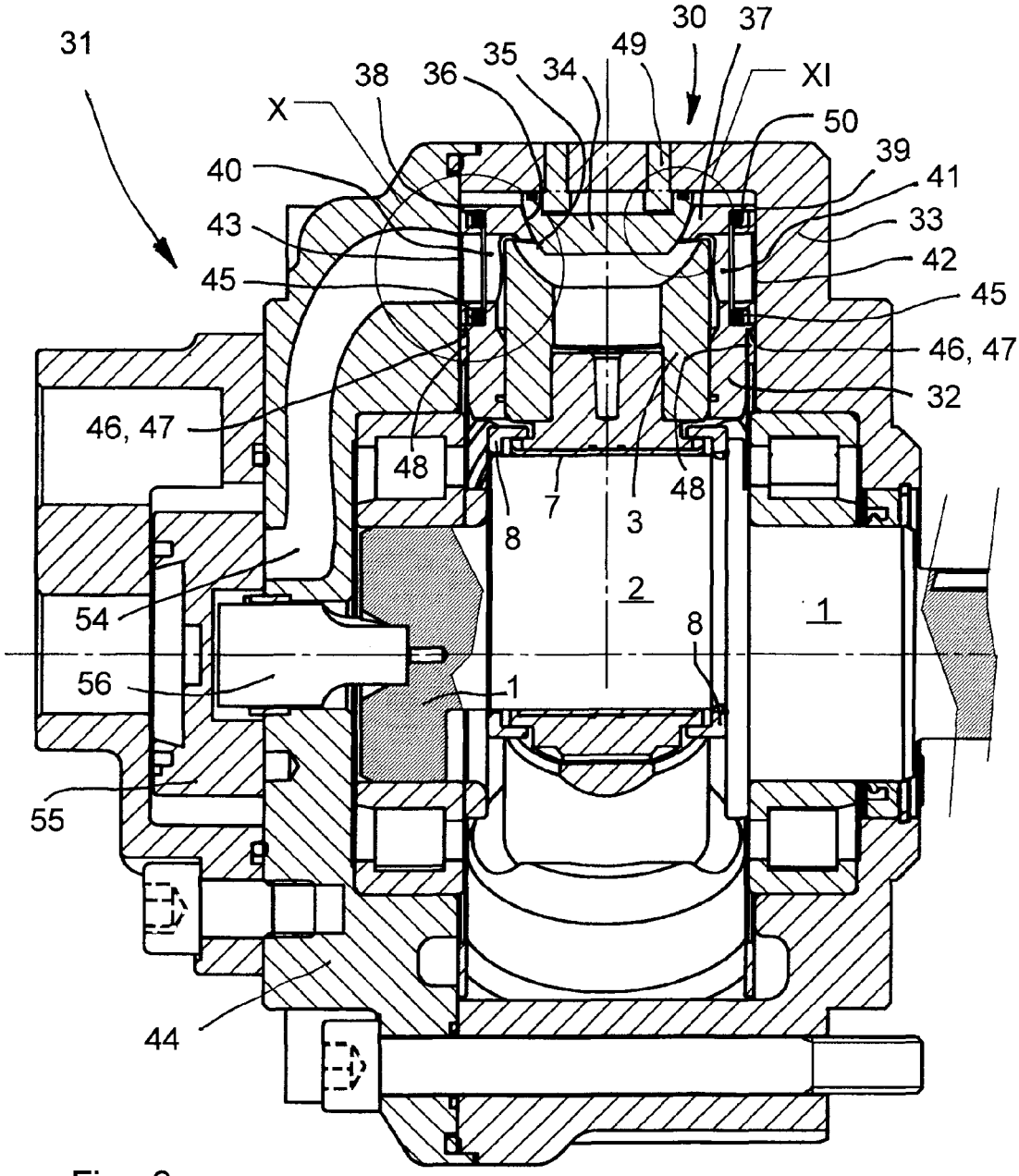
FIG. 8 represents a schematic section on a diametric plane passing through the axle of the crank shaft, in correspondence with an oscillating cylinder on the upper dead point, of a radial hydraulic machine fitted with feeding on the side of the cylinder, according to this invention, in another constructive form of feeding on the side and on the spherical oscillation surface of the cylinder.
Figure 9:
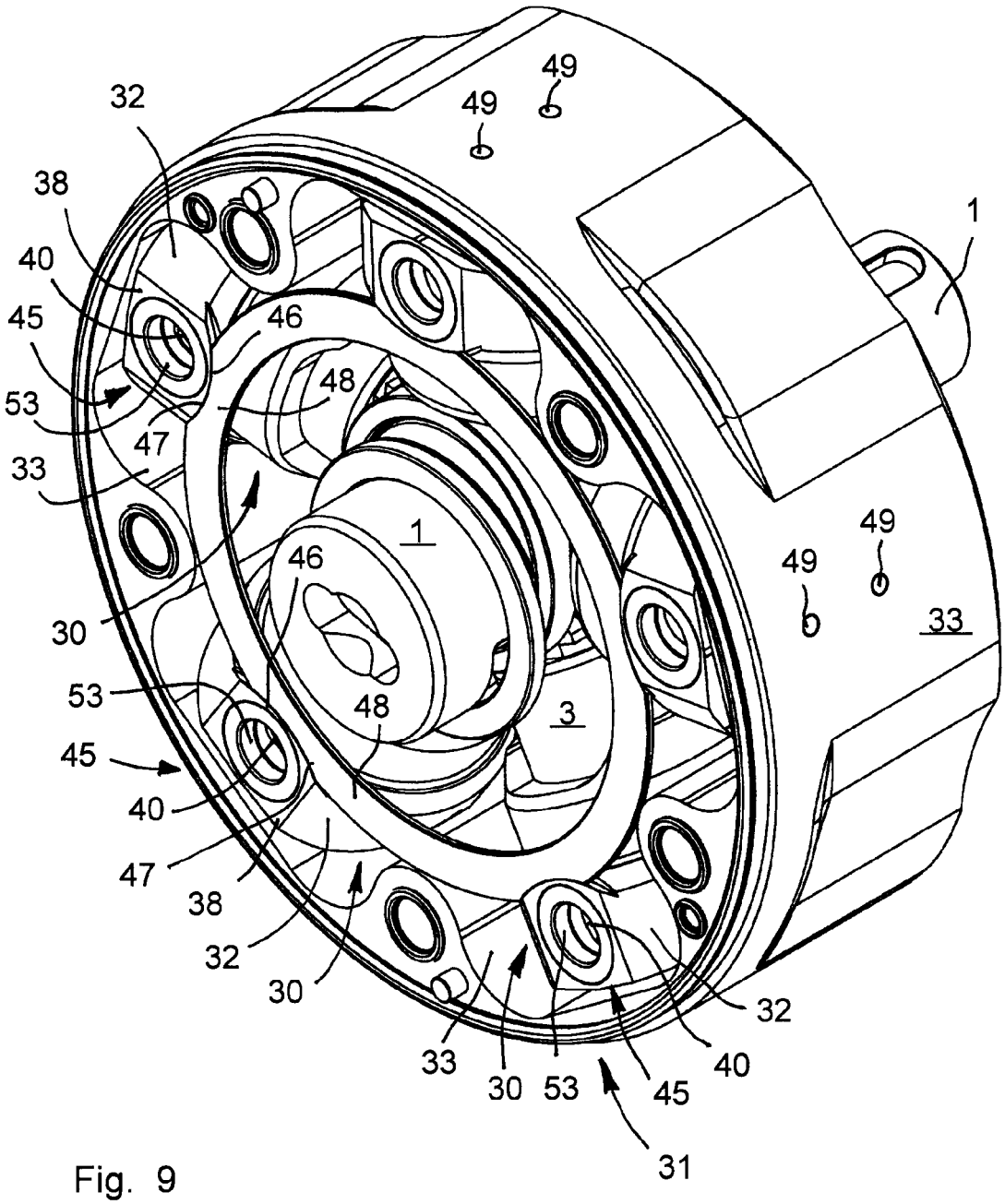
FIG. 9 represents a schematic layout in perspective of the radial hydraulic machine of FIG. 8 without the distributor cover, the distributor and the cover of the motor body, so as to illustrate the position of the thrust ring on the oscillating radial cylinders, for contact between the spherical oscillation surface compared with the motor body.
Figure 15:
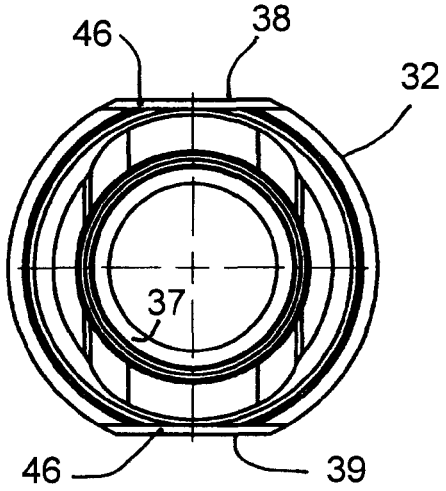
FIGS. 12, 13, 14 and 15 represent schematic layouts of the oscillating cylinder on the side, top and bottom, for the radial hydraulic machine of the previous FIG. 8
Figure 13:
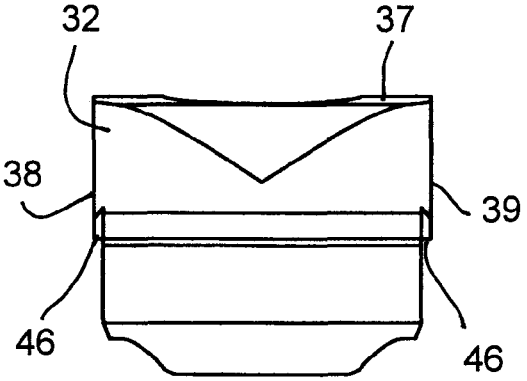
Figure 12:
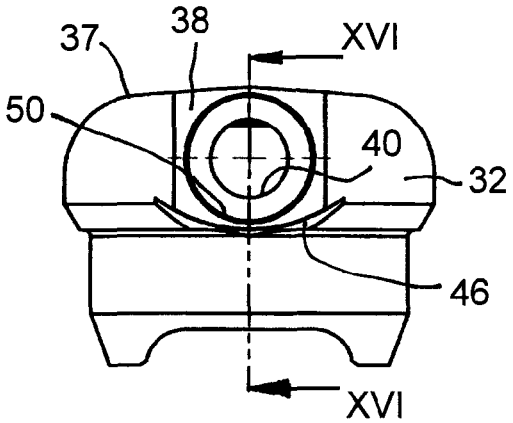
Figure 14:
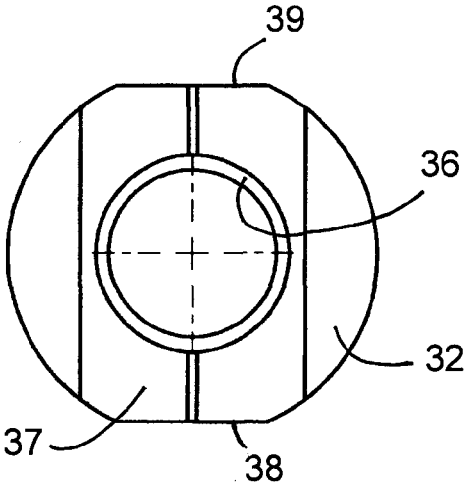

In correspondence with the feeding hole 40, in the cover 55 as can be seen in FIG. 8, there is a feeding channel 54 connected with a rotating disk distributor 55 of a known type in the technique, located in synchronous rotation with the crank shaft 1 through a front coupling 56, also well known.

Figure 19:
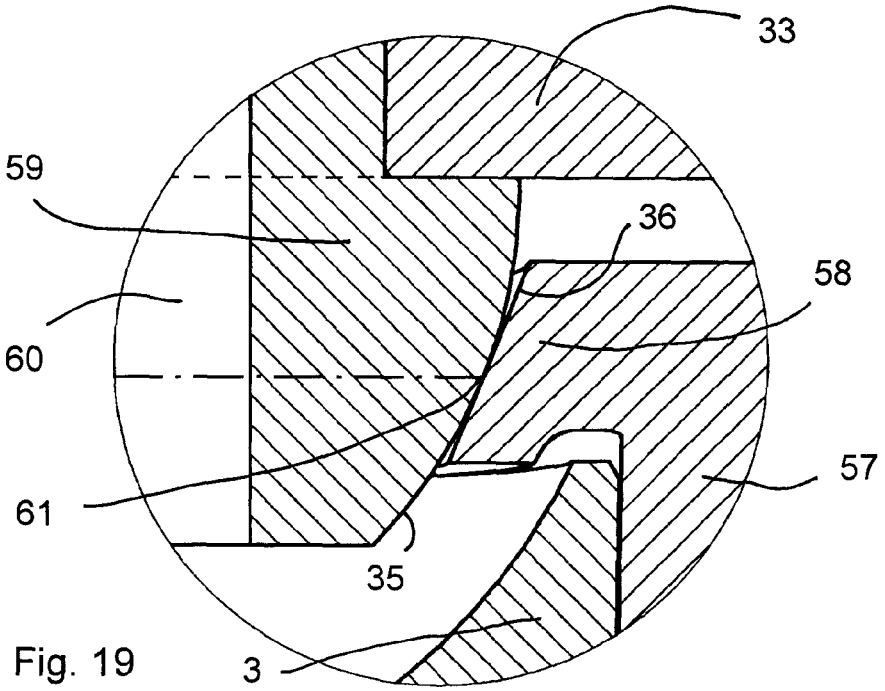
FIG. 19 represents an enlargement of a portion of the schematic section, as XI of FIG. 8, but for a spherical oscillation support of a hydraulic machine with radial cylinders according to the invention but with regular power in axles with the cylinder inside the spherical oscillation annular surface.

Creation of the support between the oscillating cylinder and the body or shell of a hydraulic machine, according to the invention, may also occur in a known manner with a feeding channel of the cylinder through the known spherical surface of oscillation. FIGS. 19 and 22 illustrate a known application of the aforementioned feeding, with support in oscillation of the cylinder according to this invention in which: a piston 3 is made sliding in an oscillating cylinder 57; the cylinder 57 is fitted with a bottom 58 on which surface an internal annular trunk-conical surface 36 exists, positioned in contact with an annular spherical surface 35, in turn created on an element 59 or created from the body or shell 33 of a hydraulic machine in which feeding is carried out in a known form through a channel 60, created close to the axis of this spherical annular surface 35. This oscillating cylinder 578 also includes thrust means of the oscillating cylinders against the spherical oscillation surface, not represented in FIG. 22, on both external sides of the oscillating cylinder 57 with the objective of maintaining the contact position between the spherical oscillation annular surfaces 35, on the mechanical element 59 and the internal conical trunk surface 36 of the bottom 58 of the oscillating cylinder 57, on the start up and in the absence of pressure of the liquid in the cylinder.

Dimensioning of the spherical annular surface should be provided for in a ratio according to the diameter of cylinder D, or bore, therefore the diameter D1 of the spherical oscillation surface of contact with it, should be less that diameter D of bore of the oscillating cylinder 32 or 57. Furthermore, the half-opening angle β of the trunk-conical annular surface 36 should be included between 4° and 60° sexagesimal, so that the radius R1 can be dimensioned in order for the circumference contact between the two annular spherical and trunk-conical surfaces close to the median area 61 of the trunk conical annular surface 36 can fall with a radius of R2, of a width limited to elastic deformation of the material.

Figure 20:
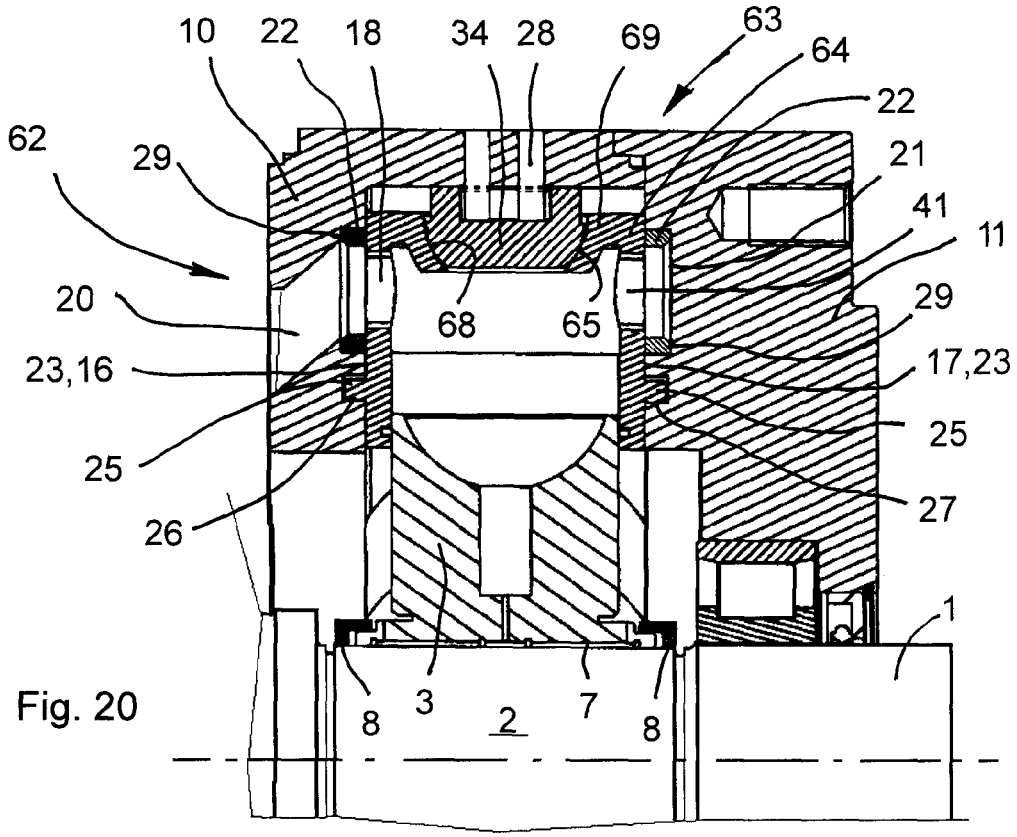
FIG. 20 represents a schematic section on a diametric plane passing through the axis of the crank shaft, in correspondence with an oscillating cylinder at the lowest dead point, of a radial hydraulic machine fitted with a spherical oscillation support with limited contact, according to another constructive form of this invention, also with power on the side of the cylinder, as in the case of the hydraulic machine of FIG. 1.

FIGS. 20, 23 and 24 illustrate a hydraulic machine 62 with oscillating radial cylinders, similar to those of FIG. 1, in which the parts with the same function are indicated with the same numerical references as FIG. 1. The cylinder-piston groups 63 formed here by a cylinder 64 and by a piston 3 fitted with a roller 7, sliding on the crank 2 and kept in contact with it by seal rings 8. The cylinder 64, to form thrust means for contact on a spherical oscillation surface 65, has arched wings 25 in arched housings 26, extracted from the body 10 and in the relative cover 11 of the hydraulic machine 62.

In the same way, as can be seen in FIGS. 23 and 24, referable to a hydraulic machine as shown in FIG. 8, each oscillating cylinder 66 is coupled in oscillation with the body 33 of the hydraulic machine, through a spherical coupling between mechanical element 67 with a spherical annular surface of oscillation 65 made axially that can be registered in a parallel direction to the crank shaft 1 and an internal arched annular surface 68 made on the external surface of the bottom 69 with the spherical oscillation annular surface 65 it is made mobile, as said, to allow for adjustment of contact between the flat parallel lateral external surfaces 16 and 17, or 42 and 43, and the sliding surface 56 and 57, on the body 33, or 10, and on the cover 44, or 11, of the hydraulic machine, through a sliding coupling with pins 28 or 49, for a short distance in a perpendicular direction to the oscillation plane of the oscillating cylinders, so as to create the best possible seal between the flat lateral external surface and the seal rings 22 or 45 in their respective housings in the body or in the cover of the hydraulic machine.

Dimensioning of the internal arched annular surface 67, in this further form of execution of contact with the spherical surface 65 for oscillation, should be provided for according to the diameter of the cylinder D, or bore, therefore diameter D1 of the spherical surface of oscillation 65 of contact with it, should be less than diameter D of the bore of the oscillating cylinder. Furthermore, the curve radius R3 of the internal arched annular surface 67 should e greater than radius R1, related to diameter D1, otherwise contact limited to a circumference is not created, and less than the infinite value (∞), corresponding to a trunk-conical surface and also so that the circumference of contact between the two surfaces falls close to a median area 61, limited to elastic deformation, of the internal arched annular surface created in the bottom, so as to create a radius R2 of the circumference of contact.

Operation of a radial hydraulic machine fitted with perfected oscillating cylinders, in the constructive forms described above, is carried out through the passage of hydraulic liquid from the feeding channel 20, 54 to the respective hole 18, 40 in the cylinder 6, 32, 64 or 66 incoming and outgoing. The cylinder 6, 32, 64 or 66, due to the effect of rotation of the crank shaft 1, oscillates by slightly moving correspondence of the holes 18, 40 compared with the channels 20, 54; therefore, the angle of oscillation is limited and movement between them is widely compensated by the dimensions of the holes and the channels themselves, also in the presence of partial misalignments, the passage section of the liquid is very large and close to the section of the channel and the feeding hole. On the opposite side, in the presence of pressure the compensation of thrusts is provided for, generated by pressure inside the cylinder 6, 32, 64 or 66, through a compensation hole 19 or 41 and a corresponding annular seal for sliding between the flat and parallel lateral external side 17, 39 of the cylinder against the flat lateral sliding surface 23, 43. The seal rings 22 or 45 have a shape that forces pressure of the liquid against the metallic rings to push against said flat lateral sliding surface 23 or 42, 43 of the bodies or covers of the radial hydraulic machine 5, 31 or 62. The dimension of the compensation hole 41 or of the niche 21 corresponds to the dimension of the feeding hole 18, 40 so as to create a slight predominance of power to maintain contact against the flat lateral sliding surface in correspondence with the feeding channel 20, 54 and to guarantee in each situation the seal of the cylinder and the flat sliding lateral surface with the feeding channel. In the presence of no pressure, the thrust for contact of the seal on the flat sliding lateral surface is guaranteed by the elasticity of the seal ring itself, as consisting of the ring made from a soft flexible material 51 in the seal ring 45. Therefore the seal ring 22, not illustrated and not housed in the cylinder, but in a housing 29 of the body 10 and a niche 21 of the cover 11, consists of a ring made from a soft flexible material, also known as an "O ring", an anti-extrusion ring of the soft ring and a metallic ring from the side on which it rests on the flat lateral sliding surface, similar to the seal ring 45.

In the perfected oscillation contact, then, between the surfaces involved in oscillation, spherical annular 35 or 65 and trunk-conical internal annular 36 or also internal arched annular 68 compared with the technical note, the contact itself is completely rigid and rather limited, for a narrow strip around the circumference of contact of radius R2, therefore in the median area 61 of the internal trunk-chronic annular surface 36 or arched 68, due to yielding by elasticity of the materials used. It therefore works with contact pressure between the materials contained if dimensioning of the surfaces has been created within the parameters indicated above, even in the presence of high an variable pressure of the hydraulic liquid, as normally occurs for radial cylinder hydraulic machines.

Further solutions proposed, as well as simple spherical contact, for execution of contact between the spherical surface of oscillation and made with spherical annular surfaces with radius R1 and diameter D1, allow for the thrust generated by the liquid in pressure to be limited in its developments in the radial oscillating cylinder if the radius R2 of the circumference of contact between the spherical annular surface of radius R1, diameter D1 and the internal trunk-conical annular surface 36, or the internal arched annular surface 68 with a curve R3, because the surface involved in generation of the thrust S is limited to an annular strip area, being the difference between the boring area, diameter D, therefore $\pi(D/2)^2$, subject to the pressure of the liquid, having deducted the area inside said circumference of radius contact R2, therefore $\pi(R2)^2$ and discharging the pressure of the liquid directly on the body 10 or 33 of the hydraulic machine, according to the invention, avoiding overcharging in the oscillation contact.

Therefore the thrust S that will be transmitted between the two surfaces in contact for oscillation of the cylinder is according to the formula $S=P\times(\pi(D/2)^2-\pi(R2)^2)$ in which P is the immediate pressure inside the cylinder during operation.

Therefore a construction with R2=D/2 results in no thrust effect of the liquid in pressure in contact between the spherical oscillation surface and the contact surface of the base 36 or 68. Therefore, dimensioning, of the radii of the spherical surface R1 and of the arched surface R3 or of the position and half-opening angle β of the trunk-conical annular surface 36, allows for controls to be made on the thrust S in the contact between them in order to limit the value within the tolerated limits from the material used in execution of the two surfaces in contact.

During operation, the presence of thrust means, such as arched wings 25 or rings 48, for the thrust of the oscillating cylinders 6, 32, 57, 64 or 66 against the spherical oscillation surface guarantee contact and seal between the oscillation surface: spherical 13 and 14; spherical annular 35 or 65 against trunk-conical annular 36 or internal arched annular 68, also during set-up or in the absence of pressure in the oscillating cylinder.

Finally, a reduction in dimensions, possible for concentration of the oscillation contact of the cylinder inside the radius R2 circumference and minimisation of the breadth of the spherical annular surface of contact between the oscillating cylinder and the body or shell of the hydraulic machine with radial cylinders, allows for larger sections of feeding channels or the discharge of hydraulic liquid to and from the hydraulic oscillating cylinder described in this invention. This effect is much more highlighted if applied to feeding of the oscillating cylinder on the side of the cylinder itself, so as to limit the typical radial dimensions o the hydraulic machines with oscillating radial cylinders known in the technique, but as FIGS. 19 and 22 show, it may be applied even in the absence of feeding on the side of the cylinder.

The advantages in execution and use of a hydraulic machine with perfected radial cylinders described above are expressed by a simple construction for execution of the oscillation surface of the cylinders through the application of a mechanical element with the cylindrical surface, spherical or annular as described. The need to allow the spherical or annular spherical oscillation surface to reposition itself in a transversal position for compensation on contact between the external flat lateral surfaces of the cylinder is easy to create as described. Therefore, the cylinder will only have an oscillation surface on the bottom and no longer, as in the technical note, passage sections of the hydraulic liquid, oscillation movement and the breadth of the passage of the liquid are no longer limited by the fixing elements of the same to the shell, also known in the technique; in reality, the section of passage between the fixed part, the body of the hydraulic machine, and mobile, as it is oscillating, a cylinder or shell and cylinder, is made through this invention in the area of the flat lateral external surface of the cylinder with less movement by oscillation, as typically occurs with oscillating cylinders with trunnions, but it has a huge advantage, compared with the latter, due to the elimination of the limit of dimensions of the feeding channel inside the trunnion. Furthermore, oscillation of the cylinder-piston group occurs on a surface in an axial position compared with the cylinder itself, on the diametric plane of development of the star of the cylinder-piston groups that form the hydraulic machine, so as to avoid upheavals in the power created by movement of the crank shaft. As the examples illustrate situations with different oscillating radial cylinders, both create the heart of the invention with oscillation of the cylinder in a limited area of contact, limited to elastic deformation of the materials in contact and/or feeding with large passage sections of the hydraulic liquid, therefore the possibility of feeding the cylinder through the flat lateral surface, so as to avoid limitations in the section of channels, ports and passage holes of the hydraulic liquid from the distributor to the cylinder; furthermore, conformation of the distributor may be of any kind, as highlighted in the execution forms in which a rotating disk distributor can be found, known in the technical specification of hydraulic machines, but at the same time in the first form of execution a distributor for versatility of the current invention does not exist.

Furthermore, the constructive forms described suit hydraulic motors, of fixed capacity, but the characteristics and advantages of this invention can be applied to hydraulic pumps with oscillating radial cylinders and, considering the known techniques that create variations to the flow rates in these hydraulic machines, motors and pumps, also with constant variation to the flow rates, so as to anticipate the oscillation surfaces, in the case of execution of radial hydraulic motors with variable flow rates, that are limited in performance with reduced flow rates with limited sections of the feeding liquid and poor lubrication of the oscillation surface of the cylinder.

In this way with feeding on the side of the oscillating cylinder it is possible to avoid that any pressure variation is discharged into the contact of spherical oscillation, therefore drastically increasing the thrusts at high pressures and low angles of oscillation of the hydraulic machines with minimum capacity, as passage of the liquid occurs perpendicular to the oscillation level of the cylinders, so as not to generate thrusts to the spherical surface of oscillation itself even if it is reduced to the sole elastic yielding of the material around the circumference of contact.

Furthermore, dimensioning of the oscillation contact between the spherical oscillation surface on the body or shell and the annular surface of the bottom of the cylinder; so much so as to make limited contact with sole elastic yielding making it easy to control in all working conditions in terms of rotation speed and pressure of the hydraulic liquid in the machine, therefore making the oscillation surfaces described with a high level of duration and limited friction to create oscillation of the cylinder in question.

Finally, the clearest advantages can be created with a reduction in dimensions and an increase in the section of passage in the channels and feeding holes of the hydraulic liquid, if applied to known hydraulic machines, therefore with feeding of the oscillating cylinder from inside the spherical oscillation surface, but further and more important advantages can be achieved with a combination of the invention described above in hydraulic machines, as well as the spherical oscillation surface 35 or 65 of the cylinder limited to the narrow strip of contact with the corresponding trunk-conical annular surface 36 or arched internal surface 68 with a greater curve, also fitted with feeding of hydraulic liquid on the side of the radial oscillating cylinder as described above.

Obviously, with the perfected radial hydraulic machine, described above, a technician from this branch, with the objective of satisfying specific and contingent requirements, may carry out several modifications, all therefore within the field of protection of this invention as defined by the following claims. Even if less advantageous, the seal ring 22 or 45, described as a composite, may be made from a combination of parts in one single piece or in a combination of two parts that, obviously, have the same characteristics of the three components: a ring made from a soft flexible material in contact with the housing, an anti-extrusion ring to avoid damages to the soft ring, for liquid pressure and a metallic ring in sliding contact on the flat lateral surface overlooking the housing. Furthermore, the metallic surface of the ring in sliding contact, obviously, is resistant to abrasion but it may be replaced, at present with higher costs, with a ceramic finish or other material with similar anti-abrasion characteristics to support contact of the seal ring with the lateral sliding surface. Furthermore, in a simplified execution of the invention, for small capacity applications, compensation of the lateral thrusts of the liquid under pressure in the oscillating radial cylinder may be achieved mechanically due to resting between the flat lateral surfaces of the cylinder, opposite the surface with feeding of the liquid passage, without chambers or bearings with a hydrostatic action of compensation.

Finally, the constructive form of the radial hydraulic machine may also be made using thrust means other than the ring 48 with arched steps 46 illustrated, but also capable of operating in the expected way, therefore pushing the cylinder against the spherical or annular spherical surface of support and oscillation, for reaction compared with the other parts of the thrust means. Furthermore, the shape of the thrust ring 48, with arched steps 46, may be different from the illustration shown, but working in the same way: push the respective cylinder against the spherical or annular spherical surface of support and oscillation, with a reaction on the other cylinders and relative parts on which it rests, as illustrated for the ring 48. In this way the thrust means consisting of arched wings 25 inside arched housings, on each cylinder 6 or 64, may be made with an arched insert like the wings, not illustrated, and introduced in arched housings, in the same way as the arched housings 26 but on the cylinder and on the flat lateral surface in contact with the side of the body or cover of the machine, not illustrated, to create a different constructive shape with similar performance in order to maintain contact of the spherical or annular spherical surfaces of oscillation of the cylinder as described.

The invention claimed is:

1. A hydraulic machine, comprising:

oscillating radial cylinders close to an external shell of a crown or star of cylinder-piston groups;

wherein pistons of the said cylinder-piston groups are made sliding on a crank shaft with throw or on interposed concentric elements which create an alternative movement in the oscillating radial cylinders, wherein said oscillating cylinders are placed in contact with a spherical oscillation surface made on a body or shell of the hydraulic machine;

wherein a passage of hydraulic liquid to and from an oscillating radial cylinder of the oscillating radial cylinders, to create feeding and discharge of the cylinder, is formed through at least a flat lateral external surface on a side of the oscillating cylinders, parallel to an oscillation plane of the cylinders, to and from a feeding channel on a lateral body or cover of the hydraulic machine;

wherein a seal ring, fitted at least with a contact surface that is resistant to abrasion on a wall of lateral flat sliding surfaces on the body or shell, is in contact with the flat lateral external surfaces of the oscillating cylinders for passage of the liquid under pressure;

wherein a thrust member is formed on the oscillating cylinders against the spherical oscillation surface outside of the cylinders themselves, and wherein the respective oscillation surface of each oscillating radial cylinder of the cylinder-piston groups is made, close to the external shell, by a portion of a spherical surface of a mechanical element which is movably connected with the shell or to a part or lateral cover of the hydraulic machine in a direction parallel to an axis of the crank shaft.

2. A hydraulic machine according to previous claim 1, wherein, to maintain contact between the oscillation surface of the oscillating radial cylinder and the body or shell of the hydraulic machine, the thrust member on the cylinder for contact, includes at least one ring fitted with arched contacts, compared with the curve of the portion of the spherical surface of oscillation of each cylinder, according to a respective curve radius of arched steps on the respective cylinders, coinciding with the curve radius compared with the oscillation surface of the cylinders on the arched elements of the thrust member.

3. A hydraulic machine according to previous claim 1, wherein, to maintain contact between the oscillation surface of the oscillating radial cylinder and the body or shell of the hydraulic machine, the thrust member on the cylinder, for contact on the portion of surface of oscillation, includes arched wings on the side of the cylinder, that are coupled in arched housings, according to a respective radius or curve compared with the curve axis of said portion of oscillation surface of the cylinder-piston group.

4. A radial cylinder hydraulic machine according to previous claim 1, wherein said oscillating cylinders are put in contact with a spherical oscillation surface created or included in the body or shell of the hydraulic machine;

wherein each oscillating radial cylinder is fitted with an internal annular surface with a greater curve of the radius of the spherical surface of oscillation, for coupling with said spherical surface of oscillation to create contact with the circumference with a width due to the sole elastic yield of the materials in a median area of the contact circumference;

wherein the radius (R2) of the circumference of contact is less than half the diameter (D) of the cylinder bore;

wherein the thrust member of the oscillating cylinders is formed against the spherical surface of oscillation outside the same cylinders;

wherein the spherical oscillation surface has a limited annular conformation close to the median area of contact around the circumference of contact with the internal annular surface;

wherein the diameter (D1) of the spherical surface of oscillation is less than the diameter (D) of the bore of the oscillating radial cylinder;

wherein a passage of the hydraulic liquid to and from the oscillating radial cylinder, to create feeding and discharge of the cylinder, is formed through at least an external lateral flat surface on the side of the oscillating cylinder, parallel to the oscillation plane of the cylinders, to and from a feeding channel on the body or cover lateral of the hydraulic machine;

wherein a seal ring, fitted at least with a contact surface that is resistant to abrasion on the wall of the flat lateral sliding surface, is interposed between the lateral surface(s) in contact for passage of the liquid in pressure.

5. A hydraulic machine according to claim 1, wherein in a flat lateral external surface, parallel and opposite to the flat lateral external surface to the oscillating cylinder crossed by feeding of the liquid, a compensation hole of thrusts formed and is fed by liquid under pressure in the oscillating cylinder, around which a seal ring is fitted at least with a surface of contact resistant to abrasion on the wall of the flat lateral sliding surface, which is positioned between the lateral flat surface in contact for passage of the liquid under pressure for the compensation hole.

6. A hydraulic machine according to claim 5, wherein the surface of action of pressure in said compensation hole of the thrusts or in a niche taken from the flat lateral sliding surface is slightly greater than the passage surface of the liquid under pressure in the feeding hole present in the oscillating radial cylinder.

7. A hydraulic machine according to claim 1, wherein the seal ring in sliding contact between a flat lateral external surface with the oscillating radial cylinder and a lateral flat sliding surface of the cylinder comprise combined parts comprising;

a metallic ring which creates the surface resistant to abrasion, present on the side of the seal in contact with the sliding surface of the seal ring;

a ring comprising a soft flexible material and interposed between the metallic ring and the housing or niche in which the seal ring is located; and an anti-extrusion ring placed between the metallic ring and the ring made from a soft flexible material to avoid expulsion for pressure of the liquid during operation.

8. A hydraulic machine according to claim 7, wherein the seal ring for the feeding hole and/or for the compensation hole of the thrusts is positioned in its own housing made in the side of the cylinder, and the seal ring is in sliding contact with the flat lateral sliding surface of the body of the radial hydraulic machine and of the cover of the radial hydraulic machine.

9. A hydraulic machine according to previous claim 4, wherein to maintain contact between the oscillation surface of the oscillating radial cylinder and the body or shell of the hydraulic machine, the thrust member on the cylinder for contact consist of at least one ring is fitted with arched contacts, compared with the curve of the portion of the spherical surface of oscillation of each cylinder, according to a respective curve radius of arched steps on the respective cylinders, coinciding with the curve radius compared with the oscillation surface of the cylinders on the arched elements of the thrust member.

10. A hydraulic machine according to previous claim 4, wherein to maintain contact between the oscillation surface of the oscillating radial cylinder and the body or shell of the hydraulic machine, the thrust member on the cylinder, for contact on the portion of surface of oscillation, consisting of arched wings on the side of the cylinder, that are coupled in arched housings, according to a respective radius or curve compared with the curve axis of said portion of oscillation surface of the cylinder-piston group.

11. A hydraulic machine, comprising:

a body including a spherical oscillation surface;

a crank formed in the body;

a plurality of oscillating cylinders formed around the crank and contacting the spherical oscillation surface of the body, an oscillating cylinder of the plurality of oscillating cylinders comprising:

a lateral flat sliding surface; and a flat lateral external surface formed on a side of the oscillating cylinder, a passage of hydraulic liquid to and from the oscillating cylinder being formed through the flat lateral external surface;

a plurality of pistons formed in the plurality of oscillating cylinders, respectively, and sliding on the crank to create an alternative movement in the plurality of oscillating cylinders;

a seal ring comprising an abrasion-resistant surface formed on the lateral flat sliding surface of the body; and a thrust member formed on an outer surface of the oscillating cylinder against the spherical oscillation surface, wherein the respective oscillation surface of each oscillating cylinder is made, close to the body, by a portion of a spherical surface of a mechanical element which is movably connected with the body in a direction parallel to an axis of the crank shaft.

12. The hydraulic machine of claim 11, wherein the body comprises an arched housing, and the thrust member comprises an arched wing fixed to a side of the cylinder and located in the arched housing.

13. The hydraulic machine of claim 11, wherein the body comprises a ring including a plurality of arched steps which are located adjacent the plurality of oscillating cylinders, respectively.

* * * * *